US006710526B1

(12) United States Patent
Helbig

(10) Patent No.: US 6,710,526 B1
(45) Date of Patent: Mar. 23, 2004

(54) HEADLIGHT LAMP HAVING BASE FLANGE WITH THREE CLIPS

(75) Inventor: Peter Helbig, Sontheim (DE)

(73) Assignee: Patent-Treuhand-Gesellschaft für elektrische Glühlampen mbh, Munich (DE)

( * ) Notice: Subject to any disclaimer, the term of this patent is extended or adjusted under 35 U.S.C. 154(b) by 1 day.

(21) Appl. No.: 10/110,273

(22) PCT Filed: Sep. 22, 2000

(86) PCT No.: PCT/DE00/03313

§ 371 (c)(1),
(2), (4) Date: Apr. 10, 2002

(87) PCT Pub. No.: WO01/31669

PCT Pub. Date: May 3, 2001

(30) Foreign Application Priority Data

Oct. 22, 1999 (DE) ..... 199 51 203

(51) Int. Cl.[7] ..... H01J 5/48; H01J 5/50

(52) U.S. Cl. ..... 313/318.01; 313/318.03; 313/318.05; 262/226; 262/548; 439/56; 439/168

(58) Field of Search ..... 313/318.01, 318.02, 313/318.05, 318.08, 318.09, 318.1; 362/226, 548, 549; 439/56, 168, 182

(56) References Cited

U.S. PATENT DOCUMENTS

| | | | | | |
|---|---|---|---|---|---|
| 3,775,731 | A | * | 11/1973 | Merki et al. | 439/556 |
| 3,885,149 | A | | 5/1975 | Wolfe et al. | 362/211 |
| 3,894,205 | A | * | 7/1975 | List et al. | 200/51.07 |
| 3,912,355 | A | * | 10/1975 | Curado et al. | 439/546 |
| 4,003,624 | A | * | 1/1977 | Smith | 439/662 |
| 4,492,893 | A | | 1/1985 | Steiner et al. | 313/318.07 |
| 4,769,574 | A | * | 9/1988 | Nagasawa et al. | 313/318.09 |
| 4,812,703 | A | * | 3/1989 | Kanematsu et al. | 313/318.07 |
| 4,841,419 | A | * | 6/1989 | Ohishi | 362/226 |
| 4,864,183 | A | * | 9/1989 | Okano | 313/318.1 |
| 5,957,569 | A | * | 9/1999 | Helbig et al. | 362/263 |

FOREIGN PATENT DOCUMENTS

| | | |
|---|---|---|
| DE | 29 39 328 | 4/1988 |
| GB | 1 407 024 | 9/1975 |
| WO | WO 97/25733 | 7/1997 |

* cited by examiner

*Primary Examiner*—Nimeshkumar D. Patel
*Assistant Examiner*—Kevin Quarterman
(74) *Attorney, Agent, or Firm*—Willaim E. Meyer

(57) ABSTRACT

The headlight bulb includes at least one lamp body (1), at least one luminous element (3) enclosed within the at least one lamp body (1), a lamp base (2) in which the at least one lamp body (1) is fixed and power connectors (4, 5) for supply of energy to the at least one luminous element (3). The lamp base (2) includes a base flange (20) and at least three reference tangs (21), which are arranged on a plane, which is level with the plane of the base flange (20). The base flange (20) further includes three clips (22) arranged around the circumference thereof, which are sprung in a direction perpendicular to the plane of the base flange and which cooperate with the reference tangs (21) to mount the bulb in a headlight.

5 Claims, 1 Drawing Sheet

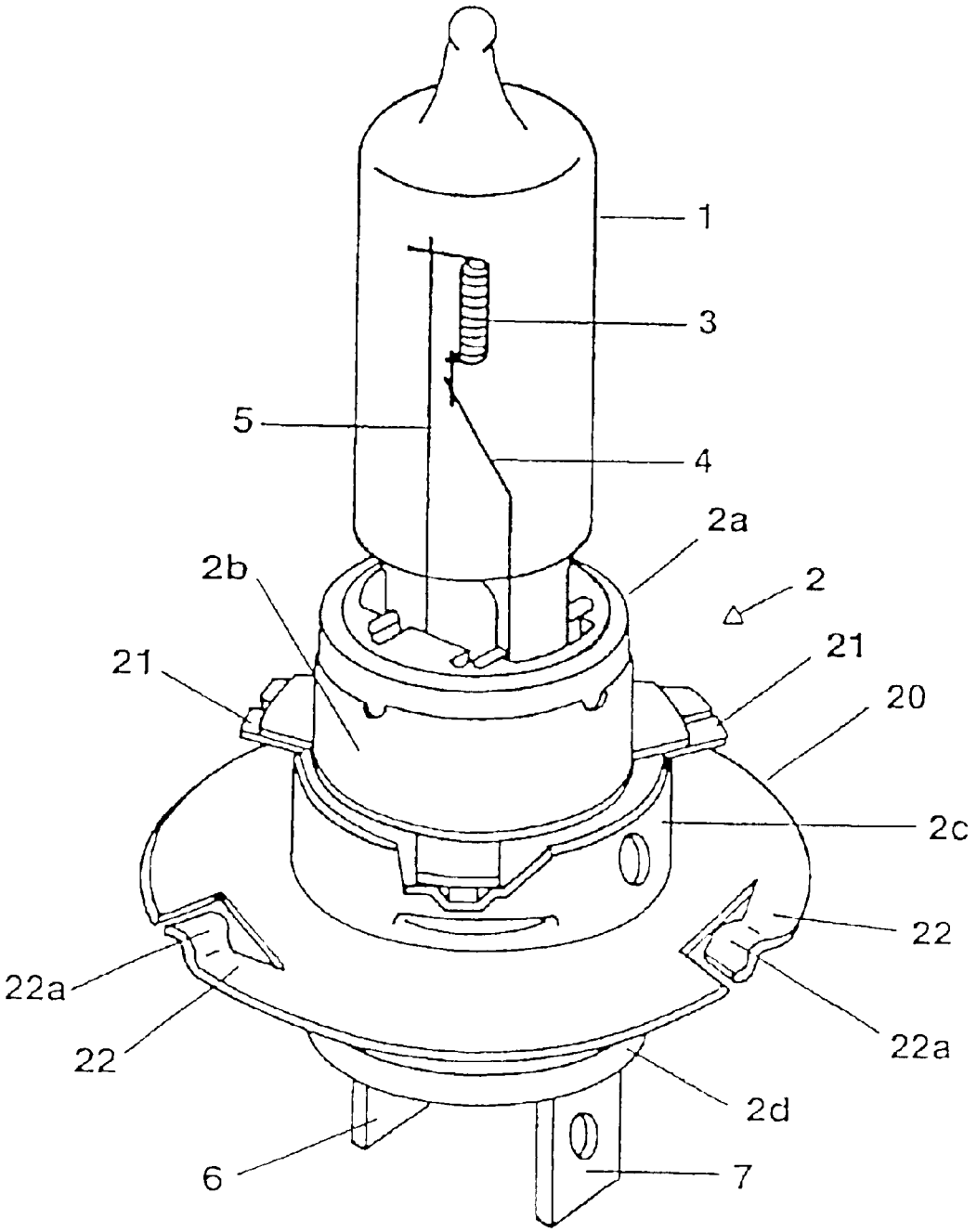
1
3
5
4
2a
2b
2
21
21
20
2c
22
22a
22
22a
2d
6
7

HEADLIGHT LAMP HAVING BASE FLANGE WITH THREE CLIPS

I. TECHNICAL FIELD

The invention relates to a headlight lamp having at least one lamp vessel, at least one luminous element, which is enclosed in the at least one lamp vessel, supply leads for supplying energy to the at least one luminous element, a lamp base, in which the at least one lamp vessel is fastened, wherein the lamp base has a base flange and at least three reference lugs arranged in a common plane parallel to the plane of the base flange.

II. BACKGROUND ART

Such a headlight lamp is disclosed, for example, in the international patent application with the publication number of WO 97/25733. This document describes a headlight lamp that has a lamp bulb, an incandescent filament surrounded by the lamp bulb, a lamp base provided with a base flange and with three reference lugs arranged in a common plane parallel to the plane of the base flange, and also supply leads for supplying energy to the incandescent filament. The base flange is equipped with a groove for holding a sealing ring. The fastening of the lamp in a rear headlight reflector opening constructed as lamp mount is performed with the aid of the reference lugs and the sealing ring resting on the base flange. The reference lugs engage in the headlight reflector opening constructed as lamp mount, and the sealing ring bears against the outer wall of the headlight reflector. The edge of the reflector opening is therefore arranged in a clamping fashion between the sealing ring and the reference lugs.

III. DISCLOSURE OF THE INVENTION

It is the object of the invention to provide a headlight lamp of the generic type with a simplified design of the base.

This object is achieved according to the invention by means of the features of patent claim 1. Particularly advantageous designs of the invention are described in the subclaims.

The headlight lamps according to the invention are distinguished by comparison with the known lamps of the generic type in that the base flange has at least three clips, arranged along the circumference of the base flange, which are constructed resiliently perpendicularly to the plane of the base flange. Together with the reference lugs, these clips permit the headlight lamp according to the invention to be fastened in a lamp mounting opening of the headlight. After the insertion of the lamp, the edge of the lamp mounting opening of the headlight is fixed in a clamping fashion between the reference lugs and the clips according to the invention. A sealing ring and a plastic base underpart of gastight construction are not required when the headlight itself is equipped with sealing means for sealing the lamp mounting opening in a gastight fashion.

The clips integrally formed on the base flange are advantageously respectively provided with a camber projecting from the plane of the base flange. Moreover, the base flange and the integrally formed clip advantageously consist of a metal. This is the simplest way to achieve a spring action perpendicular to the plane of the base flange as well as to achieve a high strength and elasticity. Since the lamp according to the invention is inserted into the lamp mounting opening of the headlight by a rotary movement, the clips integrally formed on the base flange advantageously extend in the azimuthal direction and have the same orientation. Moreover, they are preferably of homogeneous construction.

IV. BEST MODE FOR CARRYING OUT THE INVENTION

The invention is explained in more detail below on the basis of a preferred exemplary embodiment. The preferred exemplary embodiment of the invention is a single-filament halogen incandescent lamp with a cementless base that is provided for use in a motor vehicle headlight. This lamp has a glass lamp bulb 1 that is substantially cylindrical and is fixed in a metal lamp base 2. Arranged inside the lamp bulb 1 is an incandescent filament 3 that is connected to the electric base contacts 6, 7 via two supply leads 4, 5. The lamp base 2 essentially comprises a cup-shaped metal fixing ring 2*a* in which an end of the lamp bulb 1 is fastened, a metal adjusting ring 2*b* in which the fixing ring 2*a* is fixed, and a metal reference ring 2*c*. The lamp base 2 also has a base insulator 2*d* that consists of an electrically insulating material and serves to insulate the two base contacts 6, 7 electrically. The reference ring 2*c* is equipped with a substantially rotationally symmetrical base flange 20. The plane of the base flange is aligned perpendicular to the axis of the reference ring 2*c* and thus also perpendicular to the longitudinal lamp axis. Moreover, the reference ring 2*c* is provided with three reference lugs 21 that are integrally formed on its upper edge, are directed radially outward and extend in a common plane parallel to the plane of the base flange. The adjusting ring 2*b* has three welding lugs that are integrally formed on its underedge and angled off radially outward and which rest on the reference lugs 21 of the reference ring 2*c* and are welded to them 21. The base flange 20 is equipped with three homogeneous clips 22 distributed equidistantly along its circumference. The clips 22 extend not in the radial but in the azimuthal direction, and their free ends each have a camber 22*a* projecting from the plane of the base flange 20. They have the same orientation with reference to the base flange 20 and the axis of the reference ring 2*c*, that is to say the base flange 20 and the clips 22 are of symmetrical construction with reference to 120 degree rotations about the axis of the reference ring 2*c*. The clips 22 are designed in one piece with the base flange 20 and consist, just like this flange 20, of a metal. The clips 22 exert a spring action perpendicular to the plane of the base flange 20, that is to say in the direction of the axis of the reference ring 2*c* or in the direction of the longitudinal lamp axis.

The reference lugs 21 cooperate with the clips 22 when the lamp according to the invention is being mounted. The reference lugs 21 engage in the lamp mounting opening or the headlight, and bear against the inside of the headlight, while the clips 22 bear against the outside of the headlight. After the lamp has been inserted into the lamp mounting opening of the headlight, the lamp is fixed in its final position, by a quarter turn about its longitudinal axis. The edge of the lamp mounting opening is arranged in a clamping fashion between the reference lugs 21 and the clips 22. The reference lugs 21 are designed as described in patent application WO 97/25733. Moreover, as likewise disclosed in the abovementioned patent application, the lamp has a pressure spring that exerts a spring action perpendicular to the longitudinal axis of the lamp and thereby ensures lateral fixing of the lamp in the lamp mounting opening of the headlight.

What is claimed is:

1. A headlight lamp having the following features:

at least one lamp vessel, at least one luminous element, which is enclosed in the at least one lamp vessel, a lamp base, in which the at least one lamp vessel is fastened, the lamp base having a base flange and at least three reference lugs arranged in a common plane parallel to the plane of the base flange, and supply leads for supplying energy to the at least one luminous element, wherein the base flange has at least three clips, arranged along its circumference, which are constructed resiliently perpendicularly to the plane of the base flange and serve together with the reference lugs to fasten the lamp in a headlight.

2. The headlight lamp as claimed in claim 1, wherein the at least three clips in each case have a camber projecting from the plane of the base flange.

3. The headlight lamp as claimed in claim 1, wherein the base flange is of substantially rotationally symmetrical construction, and the at least three clips extend in the azimuthal direction.

4. The headlight lamp as claimed in claim 3, wherein the at least three clips are of homogeneous construction and have the same orientation.

5. The headlight lamp as claimed in claim 1, wherein the base flange and the at least three clips consist of a metal.

* * * * *